US010641053B2

(12) United States Patent
Hrupp et al.

(10) Patent No.: US 10,641,053 B2
(45) Date of Patent: May 5, 2020

(54) MODULAR FORCE MULTIPLIER FOR DOWNHOLE TOOLS

(71) Applicants: Joze John Hrupp, Montgomery, TX (US); Lloyd Murray Dallas, Streetman, TX (US)

(72) Inventors: Joze John Hrupp, Montgomery, TX (US); Lloyd Murray Dallas, Streetman, TX (US)

(73) Assignee: EXACTA-FRAC ENERGY SERVICES, INC., Conroe, TX (US)

( * ) Notice: Subject to any disclaimer, the term of this patent is extended or adjusted under 35 U.S.C. 154(b) by 74 days.

(21) Appl. No.: 16/004,771

(22) Filed: Jun. 11, 2018

(65) Prior Publication Data

US 2019/0376356 A1 Dec. 12, 2019

(51) Int. Cl.
*E21B 23/00* (2006.01)

(52) U.S. Cl.
CPC ..... *E21B 23/00* (2013.01)

(58) Field of Classification Search
CPC ..... E21B 23/00
See application file for complete search history.

(56) References Cited

U.S. PATENT DOCUMENTS

| | | | | |
|---|---|---|---|---|
| 2,769,497 | A | 11/1956 | Reistle, Jr. | |
| 2,927,638 | A | 3/1960 | Hall, Sr. | |
| 3,090,436 | A | 5/1963 | Briggs, Jr. | |
| 3,160,209 | A | 12/1964 | Bonner | |
| 4,487,258 | A | 12/1984 | Jackson et al. | |
| 5,152,340 | A | 10/1992 | Clark et al. | |
| 5,383,520 | A | 1/1995 | Tucker et al. | |
| 5,803,177 | A | 9/1998 | Hriscu et al. | |
| 5,803,182 | A * | 9/1998 | Bakke | E21B 31/113 173/91 |
| 5,810,082 | A | 9/1998 | Jordan et al. | |
| 5,890,540 | A | 4/1999 | Pia et al. | |
| 5,904,207 | A | 5/1999 | Rubbo et al. | |
| 6,253,856 | B1 | 7/2001 | Ingram et al. | |
| 6,484,805 | B1 | 11/2002 | Perkins et al. | |
| 6,564,876 | B2 | 5/2003 | Vaynshteyn | |
| 6,776,239 | B2 | 8/2004 | Elsinger et al. | |
| 6,832,654 | B2 | 12/2004 | Ravensburger et al. | |
| 7,341,111 | B2 | 3/2008 | Van et al. | |
| 7,377,854 | B2 | 3/2008 | Surjaatmadja et al. | |
| 7,500,526 | B2 | 3/2009 | Telfer | |
| 7,789,163 | B2 | 9/2010 | Kratochvil et al. | |
| 8,201,631 | B2 | 6/2012 | Stromquist et al. | |
| 8,335,615 | B2 | 12/2012 | Hughes et al. | |
| 8,336,615 | B2 | 12/2012 | Hughes et al. | |
| 8,490,702 | B2 | 7/2013 | Stromquist et al. | |
| 9,016,390 | B2 | 4/2015 | Stewart et al. | |
| 9,334,714 | B2 | 5/2016 | Stromquist et al. | |
| 9,580,990 | B2 | 2/2017 | Flores et al. | |
| 9,598,939 | B2 | 3/2017 | Lee | |
| 2005/0077053 | A1 | 4/2005 | Walker et al. | |
| 2007/0034370 | A1 | 2/2007 | Moyes | |
| 2015/0376979 | A1 | 12/2015 | Mitchell et al. | |
| 2016/0369585 | A1 | 12/2016 | Limb et al. | |

* cited by examiner

*Primary Examiner* — Brad Harcourt
(74) *Attorney, Agent, or Firm* — J. Bennett Mullinax, LLC

(57) ABSTRACT

A modular force multiplier converts a push-down force applied to a work string from the surface into a multiplied linear force that can be used to operate downhole tools to perform tasks requiring the application of linear force.

20 Claims, 4 Drawing Sheets

MODULAR FORCE MULTIPLIER FOR DOWNHOLE TOOLS

CROSS REFERENCE TO RELATED APPLICATIONS

This is the first application for this invention.

FIELD OF THE INVENTION

This invention relates in general to tools for performing downhole operations that require an application of mechanical force and, in particular, to a novel modular force multiplier for generating mechanical force in downhole tools on an as required basis.

BACKGROUND OF THE INVENTION

Various arrangements for providing mechanical force to perform operations with downhole tools for accomplishing certain downhole tasks are known. For example, piston assemblies for converting pumped fluid pressure to linear mechanical force in a downhole tool are used in setting tools for packers, plugs, liner top hangers, casing patches, etc., as well as downhole tools such as straddle packers, tubing perforators and the like. Such piston assemblies employ a plurality of pistons connected in series to an inner or outer mandrel of a downhole tool to increase the linear force that can be generated from a given fluid pressure of fluid pumped down through a work string to the downhole tool. An example of one such piston assembly can be found in U.S. Pat. No. 8,336,615 which issued on Dec. 25, 2012. While such piston assemblies have proven useful, it is at times desirable to utilize pumped fluid pressure for a different or additional purpose. A means of downhole force multiplication that does not reply on pumped fluid pressure is therefore desirable. One such alternative force multiplier, which operates on a pull-up force applied from the surface to a work string connected to a modular force multiplier, is described in Applicant's co-pending U.S. patent application Ser. No. 15/980,992 filed May 16, 2018, the entire specification of which is incorporated herein by reference.

However, there remains a need for a modular force multiplier for downhole tools that operates on a push-down force applied from the surface to a work string connected to the modular force multiplier.

SUMMARY OF THE INVENTION

It is therefore an object of the invention to provide a modular force multiplier for downhole tools.

The invention therefore provides a force multiplier module, comprising a small piston sub connected to a work string, the small piston sub having a small piston that reciprocates, in response to movement of the work string, on a large piston mandrel within a small piston sleeve, and a large piston on an end of the large piston mandrel that reciprocates within a large piston sleeve in response to contained fluid urged by corresponding reciprocation of the small piston.

The invention further provides a force multiplier module, comprising: a small piston sub connected on one end to a debris management sleeve, the small piston sub including a small piston surrounding a central passage therethrough; a small cylinder sleeve having small cylinder sleeve anchors that pass through small cylinder sleeve anchor slots in the small piston sub, the small cylinder sleeve surrounding the small piston; a sleeve connector to which the small cylinder sleeve anchors are connected; a large cylinder sleeve connected to a downhole end of the small cylinder sleeve, the large cylinder sleeve having at least one fluid port adjacent a central passage therethrough; a large piston mandrel that extends through the central passage in the large cylinder sleeve, a central passage in the sleeve connector and the central passage in the small piston sub; and a large piston on an end of the large piston mandrel, the large piston being received in the large piston sleeve.

The invention yet further provides a modular farce multiplier, comprising: a work string connection sub; and at least one force multiplier module connected to the work string connection sub, the at least one force multiplier module comprising: a small piston sub connected on one end to a debris management sleeve, the small piston sub including a small piston surrounding a central passage therethrough; a small cylinder sleeve having, small cylinder sleeve anchors that pass through small cylinder sleeve anchor slots in the small piston sub, the small cylinder sleeve surrounding the small piston; a sleeve connector to which the small cylinder sleeve anchors are connected; a large cylinder sleeve connected to a downhole end of the small cylinder sleeve, the large cylinder sleeve having at least one fluid port adjacent a central passage therethrough; a large piston mandrel that extends through the central passage in the large cylinder sleeve, a central passage in the sleeve connector and the central passage in the small piston sub; and a large piston on an end of the large piston mandrel, the large piston being received in the large piston sleeve; whereby urging the small piston sub to slide over the large piston mandrel forces contained fluid through ports in the large cylinder sleeve to urge corresponding movement of the large piston.

The invention still further provides a modular force multiplier, comprising: a work string connection sub; a bumper mandrel connected to the work string connection sub, the bumper mandrel having a bumper mandrel socket end; a bumper mandrel stop sub that reciprocates, on the bumper mandrel between the work string connection sub and the bumper mandrel socket end; a bumper mandrel sleeve connected to a downhole end of the bumper mandrel stop sub, the bumper mandrel sleeve defining a bumper mandrel chamber in which the bumper mandrel socket end reciprocates; a sleeve connector connected to a lower end of the bumper mandrel sleeve; a small cylinder sleeve connected on one end to the sleeve connector; a large cylinder sleeve connected to an opposite end of the small cylinder sleeve; a large piston adapted to reciprocate in a large piston chamber of the large cylinder sleeve, the large piston having a large piston mandrel that extends through central passages in the large cylinder sleeve and the sleeve connector; a small piston sub having a small piston surrounding, a central passage therethrough, the small piston being adapted to reciprocate on the large piston mandrel within the small cylinder sleeve; and a debris management sleeve connecting the small piston sub to the work string connection sub; whereby manipulating the work string to urge movement of the small piston sub moves the small piston to force contained fluid in the small piston sleeve through ports in the large cylinder sleeve, to urge corresponding movement of the large piston.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

Figure 1:
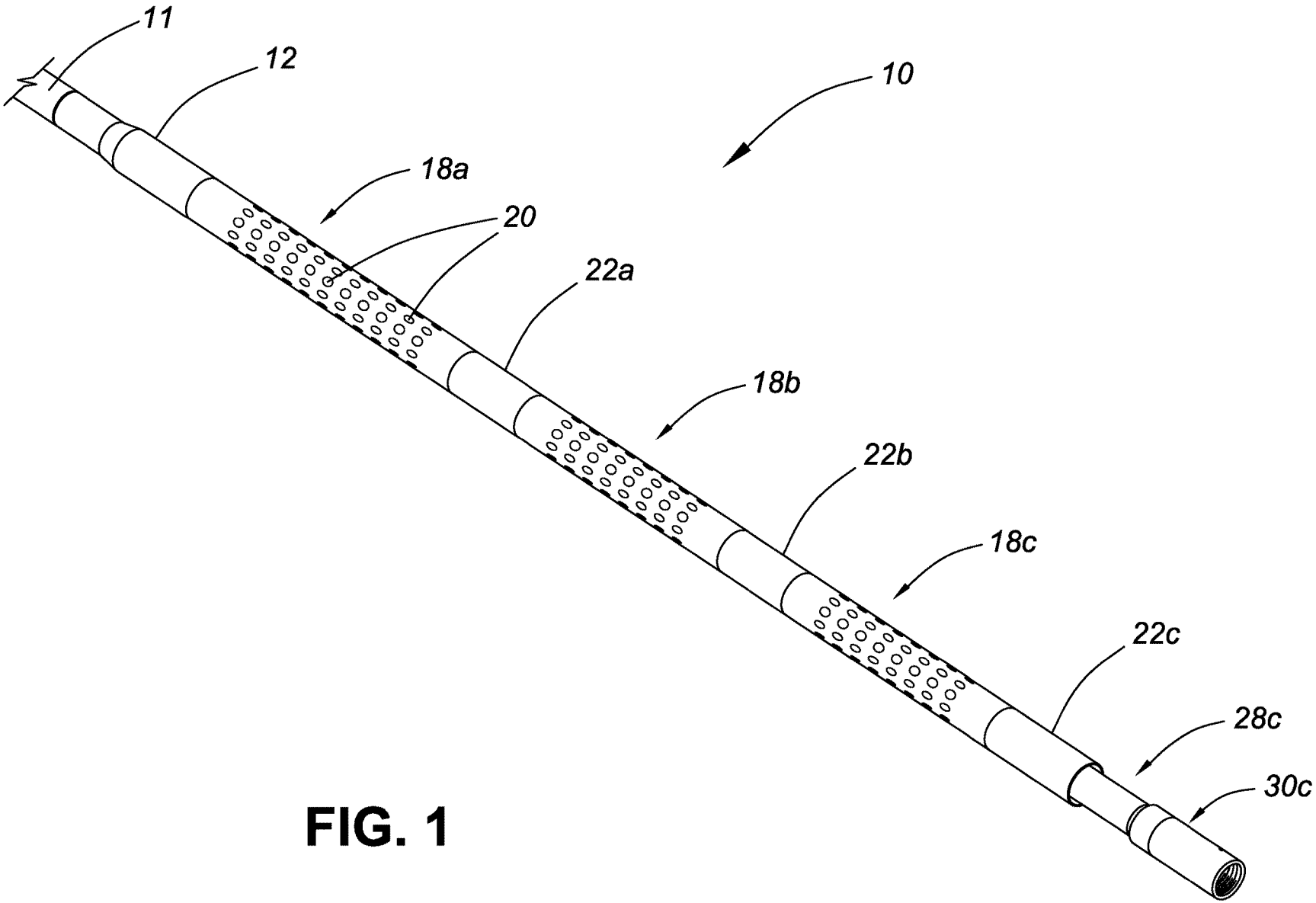
FIG. 1 is a perspective view of one embodiment of a modular force multiplier for a downhole tool in accordance with the invention.

The invention provides a modular force multiplier for downhole tools. The modular force multiplier is connected to a work string and converts a push-down force, applied form the surface to the work string, into a multiplied linear force. The multiplied linear force can be employed to perform an action using a downhole tool. The downhole tool can be used, by way of example only, to: set slips; set plugs; set packers; perforate a casing or tubing; open or close a sliding sleeve valve; fish stuck objects using a jar; or, perform many other downhole tool functions, or combinations of downhole tool functions, requiring the application of linear force. Contained fluid in the modular force multiplier is used to multiply the push-down force applied from the surface to the work string. Each module of the modular force, multiplier includes a small piston sub that is reciprocated by the work string on a piston rod of a large piston of the modular force multiplier. The small piston sub includes a small piston that reciprocates in a small piston chamber. The small piston urges a proportion of the contained fluid into a large piston chamber to drive the large piston, thus multiplying the applied force. The number of modules in the modular force multiplier determines the amount of force multiplication provided by, the modular force multiplier.

| Part No. | Part Description |
|---|---|
| 10 | Modular force multiplier |
| 11 | Work string |
| 12 | Work string connection sub |
| 14 | Work string connection |
| 16 | Work string connection sub thread |
| 18a-18c | Debris management sleeves |
| 20 | Debris management bores |
| 22a-22c | Small piston subs |
| 24a-24c | Small piston sub upper threads |
| 26a-26b | Small piston sub lower threads |
| 28a-28c | Small cylinder sleeves |
| 30a-30c | Large cylinder sleeves |
| 32 | Bumper mandrel |
| 34 | Bumper mandrel thread connection |
| 36 | Bumper mandrel stop sub |
| 38 | Bumper mandrel stop seal |
| 40 | Bumper mandrel chamber |
| 42 | Bumper mandrel sleeve |
| 44 | Bumper mandrel socket end |
| 46 | Compression spring |
| 48 | Compression spring upper socket |
| 50 | Compression spring lower socket |
| 52a-52c | Sleeve connectors |
| 54a-54c | Sleeve connector upper threads |
| 56a-56c | Sleeve connector lower threads |
| 58a-58c | Sleeve connector fluid seals |
| 60a-60i | Small cylinder sleeve anchors |
| 62a-62i | Small cylinder sleeve anchor slots |
| 64a-64c | Small cylinder sleeve anchor rings |
| 66a-66i | Small cylinder sleeve lock screws |

-continued

| Part No. | Part Description |
|---|---|
| 68a-68c | Large piston chamber |
| 70a-70c | Large cylinder sleeve thread |
| 72a-72f | Larqe cylinder sleeve ports |
| 74a-74c | Large piston mandrels |
| 76 | Multipart mandrel central passage |
| 78a-78c | Large pistons |
| 80a-80c | Large piston seals |
| 82a-82c | Large piston threads |
| 84a-84c | Large piston chamber pressure equalization bores |
| 86 | Debris management bores |
| 88a-88c | Small pistons |
| 90a-90c | Small piston outer seals |
| 92a-92c | Small piston inner seals |
| 94a-94c | Small cylinder fill bores |
| 96a-96c | Small cylinder fill plugs |
| 100 | Modular force multiplier module |

FIG. 1 is a perspective view of one embodiment of a modular force multiplier 10 in accordance with the invention. The modular force multiplier 10 is shown in a run-in condition for being run into a wellbore. A work string 11, which may be a jointed tubing or a coil tubing work string, is connected to a work string connection sub 12 at an uphole end of the modular force multiplier 10. An outer shell of one embodiment of the modular force multiplier 10 includes a plurality of debris management sleeves 18*a*, 18*b* and 18*c* that connect respective small piston subs 22*a*, 22*b* and 22*c* to the work string connection sub 12. In this embodiment, the respective debris management sleeves 18*a*-18*c* include a plurality of debris management bores 20, the function of which will be explained below with reference to FIG. 2. In this embodiment, an inner core of the modular force multiplier 10, which will be described below in detail with reference to FIG. 2, includes a plurality of small cylinder sleeves, 28*a*-28*c*, connected on their downhole ends to a plurality of large cylinder sleeves 30*a*-30*c*. Only one small cylinder sleeve 28*c* and one large cylinder sleeve 30*c* are visible in this perspective view. A push-down force applied from the surface to the work string 11 is converted by the modular force multiplier 10 into a multiplied linear mechanical force that can be utilized to operate a downhole tool (not shown), as will be explained below in more detail with reference to FIGS. 2 and 4. In this embodiment, the modular force multiplier 10 is urged from the run-in condition to a multiplied-force position shown in FIG. 4 after the downhole tool (not shown) is anchored in a wellbore, so the push-down force may be applied by manipulation of the work string, at the surface using a well rig or a work string injection tool, each of which is very well known in the art.

Figure 2:
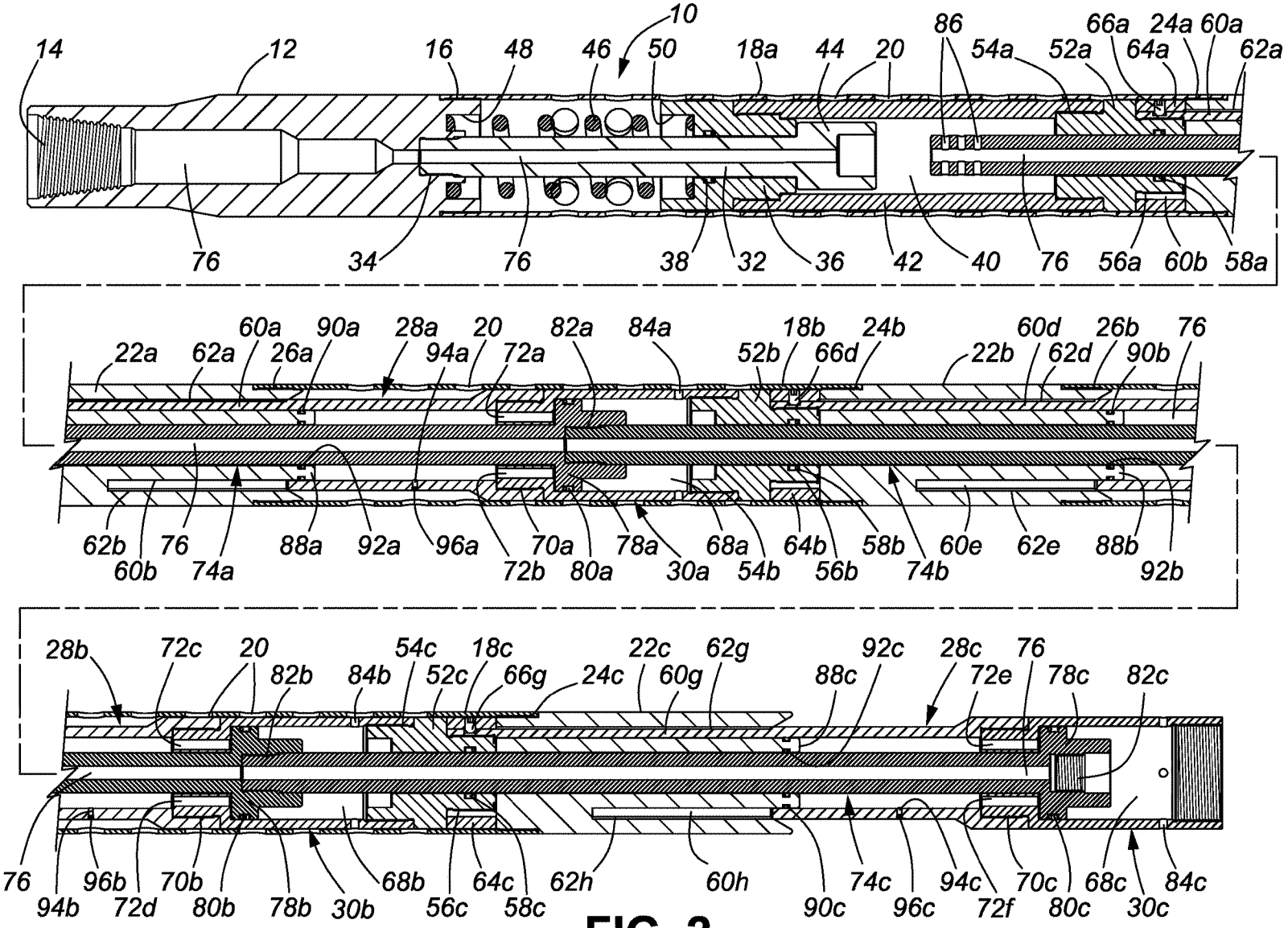
FIG. 2 is a cross-sectional view of the modular force multiplier shown in FIG. 1.

FIG. 2 is a cross-sectional view of the modular force multiplier 10 shown in FIG. 1. In this embodiment a work string connection 14 for connecting the work string 11 (see FIG. 1) to the work string connection sub 12 is threaded for the connection of a jointed tubing work string, but the configuration of the work string connection 14 is a matter of design choice. The work string connection 14 may be configured for the connection of a coil tubing string, or any other type of work string capable of being used to apply the push-down force to the modular force multiplier 10 after the downhole tool has been anchored in a wellbore. As explained above, the outer shell of one embodiment of the modular force multiplier 10 includes the plurality of debris management sleeves 18*a*, 18*b* and 18*c* that connect respective small piston subs 22*a*, 22*b* and 22*c* to a work string connection sub thread 16 of the work string connection sub 12. In this embodiment, the respective debris management sleeves 18*a*-18*c* respectively include the plurality of debris management bores 20. The debris management bores 20 serve to pressure balance moving parts of the inner core of the modular force multiplier 10 as it is moved from the run-in, condition shown in FIG. 2 to the force-multiplied condition shown in FIG. 4. As understood by those skilled in the art, such pressure balancing requires the intake and exhaust of ambient wellbore fluid, which may be laden with particulate debris, at times including proppants. The debris management bores 20 permit the particulate debris to be ejected from the modular force multiplier 10 as it is moved from the run-in to the force-multiplied condition, and vice versa.

In this embodiment, the inner core of the modular force multiplier 10 includes a plurality of small cylinder sleeves, 28*a*-28*c*, connected on their downhole ends to a plurality of large cylinder sleeves 30*a*-30*c*. A bumper mandrel 32 connects the inner core of the modular force multiplier 10 to the work string connection sub 12. The bumper mandrel 32 is connected to the work string connection sub 12 by a bumper mandrel thread connection 34. The bumper mandrel 32 passes through a central passage of a bumper mandrel stop sub 36. A bumper mandrel stop seal 38 inhibits a migration of well fluid into a bumper mandrel chamber 40. A bumper mandrel sleeve 42 connected to a downhole end of the bumper mandrel stop sub 36 defines the bumper mandrel chamber 40. A bumper mandrel socket end 44 of the bumper mandrel 32 reciprocates within the bumper mandrel chamber 40. A compression spring 46 having an uphole end housed in a compression spring upper socket 48 and a downhole end housed in a compression string lower socket 50 constantly urges the inner core of the modular force multiplier 10 to the run-in condition. The bumper mandrel 32 and compression spring 46 permit the modular force multiplier 10 to be run through constrictions in a wellbore without deploying the force multiplication function of the modular force multiplier 10. A downhole end of the bumper mandrel sleeve 42 is connected to a sleeve connector upper thread 54*a* on an uphole end of a first sleeve connector 52*a*. The sleeve connector 52*a* has a sleeve connector lower thread 56*a* to which small cylinder sleeve anchors 60*a*-60*c* (only 60*a* and 60*b* are visible in this view) are threadedly connected. The small cylinder sleeve anchors 60*a*-60*c* are an integral part of the small cylinder sleeve 28*a* (see FIG. 3). The small cylinder sleeve anchors 60*a*-60*c* are locked on the sleeve connector 52*a* by a small cylinder sleeve anchor ring 64*a*, which is locked in place by 3 small cylinder sleeve lock screws 66*a*-66*c* (only 66*a* is visible in this view). The sleeve connector 52*a* has a central passage that accommodates a first large piston mandrel 74*a*. A sleeve connector fluid seal 58*a* inhibits a migration of pumped fluid from the bumper mandrel chamber 40 around the first large piston mandrel 74*a*.

As explained above, the small piston sub 22*a* is connected to a downhole end of the debris management sleeve 18*a*. As will be explained below with reference to FIG. 3, the small piston sub 22*a* is a cylindrical body having a small piston sub upper thread 24*a* to which a downhole end of the debris management sleeve 18*a* is threadedly connected. A small piston sub lower thread 26*a* threadedly connects the debris management sleeve 18*b* to a downhole end of the small piston sub 22*a*. The small piston sub 22*a* has three annular slots 62*a*-62*c* (only 62*a* and 62*b* are visible in this view) that accommodate the three small cylinder sleeve anchors 60*a*-60*c* (only 60*a* and 60*b* are visible in this view). The small piston sub 22*a* likewise includes a small piston 88*a* surrounding a central passage through the small piston sub 22*a*. The small piston 88*a* has a small piston outer seal 90*a* and a small piston inner seal 92*a*. The small piston outer seal 90*a* provides a fluid seal against the small cylinder sleeve 28*a*. The small piston inner seal 92*a* provides a fluid seal against the large piston mandrel 74*a*.

A large cylinder sleeve 30*a* is threadedly connected by a large cylinder sleeve thread 70*a* to a downhole end of the small cylinder sleeve 28*a*. The large cylinder sleeve 30*a* includes at least two large cylinder sleeve ports 72*a*, 72*b* that permit a forced reciprocation of contained fluid into and from a large piston chamber 68*a* on a backside of a large piston 78*a*, in response to reciprocation of the small piston 88*a*, as will be explained below in more detail with reference to FIG. 4. The large piston 78*a* reciprocates within the large piston chamber 68*a* in response to corresponding movement of the small piston 88*a*. A large piston seal 80*a* inhibits the migration of contained fluid from the backside of the large piston 78*a*. Large piston threads 82*a* connect a second large piston mandrel 74*b* to the large piston 78*a*. Large piston pressure equalization bores 84*a* equalize pressure within the large piston chamber 68*a* as the large piston 78*a* reciprocates from the run-in condition to the force-multiplied condition. Debris management bores 86 in the large piston mandrel 74*a* facilitate evacuation from the bumper mandrel chamber 40 of particulates in fluid pumped through the modular force multiplier 10 during use. A downhole end of the large cylinder sleeve 30*a* is connected to the sleeve connector upper threads 54*b* of sleeve connector 52*b*.

The sleeve connector 52*b* has a sleeve connector lower thread 56*b* to which small cylinder sleeve anchors 60*d*-60*f* (only 60*d* and 60*e* are visible in this view) are threadedly connected. The small cylinder sleeve anchors 60*d*-60*f* are an integral part of the small cylinder sleeve 28*b*. The small cylinder sleeve anchors 60*d*-60*f* are locked on the sleeve connector 52*b* by a small cylinder sleeve anchor ring 64*b*, which is locked in place by three small cylinder sleeve lock screws 66*d*-66*f* (only 66*d* is visible in this view). The sleeve connector 52*b* has a central passage that accommodates a second large piston mandrel 74*b*. A sleeve connector fluid seal 58*b* inhibits a migration of well fluid from the piston chamber 68*a* around the second large piston mandrel 74*b*.

As explained above, the small piston sub 22*b* is connected to a downhole end, of the debris management sleeve 18*b* by a small piston sub upper thread 24*b*. A small piston sub lower thread 26*b* threadedly connects the debris management sleeve 18*c* to a downhole end of the small piston sub 22*b*. The small piston sub 22*b* has three annular slots 62*d*-62*f* (only 62*d* and 62*e* are visible in this view) that accommodate the three small cylinder sleeve anchors 60*d*-60*f*. The small piston sub 22*b* likewise includes a small piston 88*b* that surrounds a central passage therethrough. The small piston 88*b* has a small piston outer seal 90*b* and a small piston inner seal 92*b*.

A large cylinder sleeve 30*b* is threadedly connected by a large cylinder sleeve thread 70*b* to a downhole end of the small cylinder sleeve 28*b*. The large cylinder sleeve 30*b* includes at least two large cylinder sleeve ports 72*c*, 72*d* that permit a forced reciprocation of contained fluid into and from a large piston chamber 68*b* on a backside of a large piston 78*b*, by reciprocation of the small piston 88*b*. The large piston 78*b* reciprocates within the large piston chamber 68*b*. A large piston seal 80*b* inhibits a migration of contained fluid from the backside of the large piston 78*b*. Large piston threads 82*b* connect a third large piston mandrel 74*c* to the large piston 78*b*. Large piston pressure equalization bores 84*b* equalize pressure within the large piston chamber 68*b* as the large piston 78*b* reciprocates from the run-in condition to the force-multiplied condition. A downhole end of the large cylinder sleeve 30*b* is connected to sleeve connector upper threads 54*c* of sleeve connector 52*c*.

The sleeve connector 52*c* has a sleeve connector lower thread 56*c* to which small cylinder sleeve anchors 60*g*-60*i* (only 60*g* and 60*h* are visible in this view) are threadedly connected. The small cylinder sleeve anchors 60*g*-60*i* are an integral part of the small cylinder sleeve 28*c*. The small cylinder sleeve anchors 60*g*-60*i* are locked on the sleeve connector 52*c* by a small cylinder sleeve anchor ring 64*c*, which is locked in place by three small cylinder sleeve lock screws 66*g*-661 (only 66*g* is visible in this view). The sleeve connector 52*c* has a central passage that accommodates the third large piston mandrel 74*c*. A sleeve connector fluid seal 58*c* inhibits a migration of well fluid from the piston chamber 68*b* around the third large piston mandrel 74*c*.

As explained above, the small piston sub 22*c* is connected to a downhole end of the debris management sleeve 18*c* by a small piston sub upper thread 24*c*. The small piston sub 22*c* has three annular slots 62*g*-62*i* (only 62*g* and 62*h* are visible in this view) that accommodate the three small cylinder sleeve anchors 60*g*-60*i*. The small piston sub 22*c* likewise includes a small piston 88*c* that surrounds a central passage therethrough. The small piston 88*c* has a small piston outer seal 90*c* and a small piston inner seal 92*c*.

The large cylinder sleeve 30*c* is threadedly connected by a large cylinder sleeve thread 70*c* to a downhole end of the small cylinder sleeve 28*c*. The large cylinder sleeve 30*c* includes at least two large cylinder sleeve ports 72*e*, 72*f* that permit the forced reciprocation of contained fluid into and from a large piston chamber 68*c* on a backside of a large piston 78*c*, by reciprocation of the small piston 88*c*. The large piston 78*c* reciprocates within the large piston chamber 68*c*. A large piston seal 80*c* prevents the migration of contained fluid from the backside of the large piston 78*c*. Large piston threads 82*c* permit the connection of an operative component of a downhole tool (not shown) to the modular force multiplier 10. Large piston pressure equalization bores 84*c* equalize pressure within the large piston chamber 68*c* as the large piston 78*c* reciprocates from the run-in condition to the force-multiplied condition when the modular force multiplier 10 is connected to the downhole tool. A downhole end of the large cylinder sleeve 30*c* is connected to an outer sleeve of the downhole tool.

Figure 3:
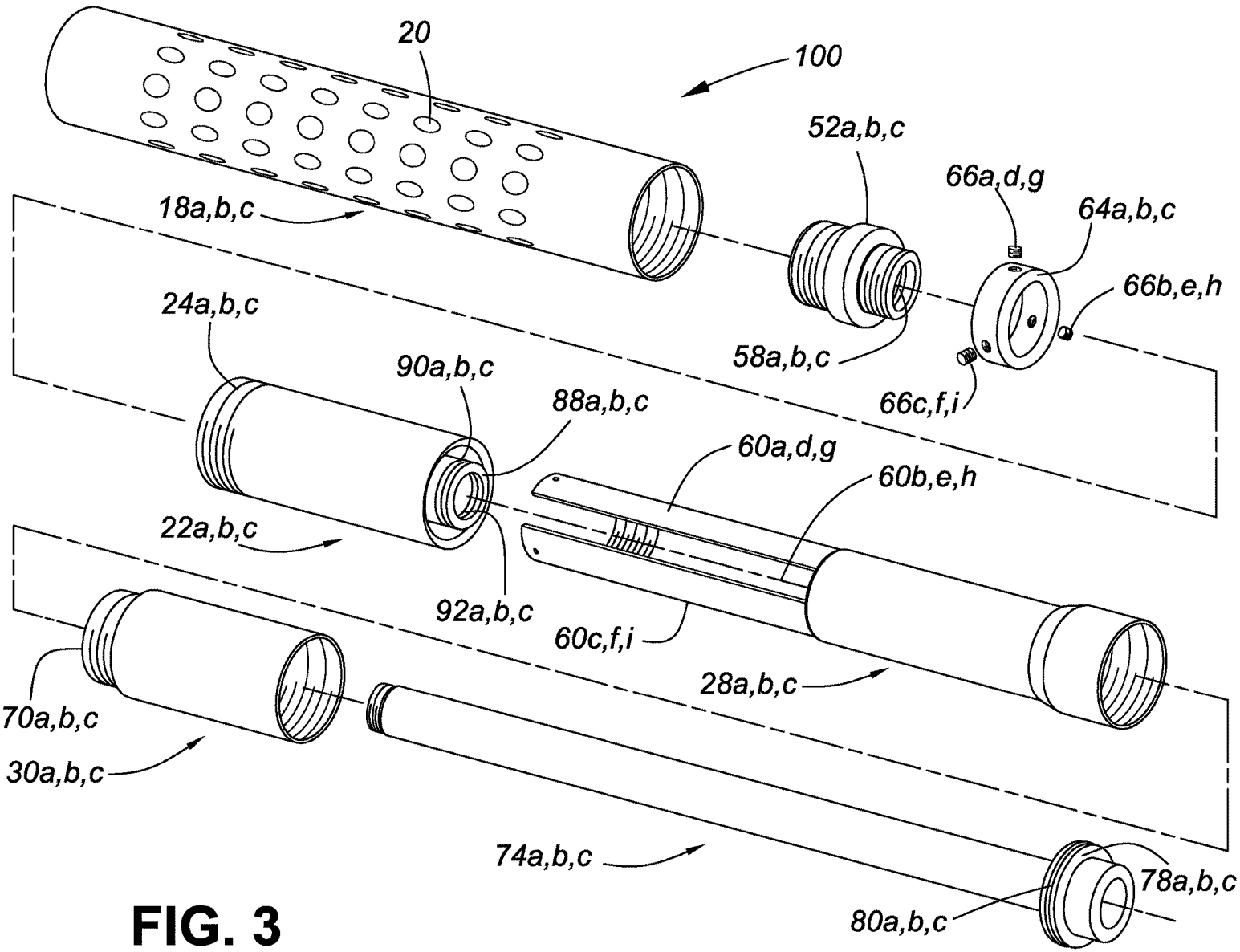
FIG. 3 is an exploded perspective view of a module of the modular force multiplier shown in FIG. 1.

FIG. 3 is an exploded perspective view of a modular force multiplier module 100 of the modular force multiplier 10 shown in FIG. 1. As explained in detail above, each modular force multiplier module 100 includes one of the debris management sleeves 18*a*-18*c* and one of the sleeve connectors 52*a*-52*c*. One of the small cylinder sleeve anchor rings 64*a*-64*c* anchors the three small cylinder sleeve anchors, collectively 60*a*-60*i*, to the respective sleeve connector 52*a*-52*c* using three of the respective small cylinder sleeve lock screws 66*a*-66*i*. The respective small cylinder sleeve anchors 60*a*-60*i* of the respective small cylinder sleeves 28*a*-28*c* respectively pass through the radial slots (see FIG. 2) in the respective small piston subs 22*a*-22*c*. The respective small piston subs 22*a*-22*c* respectively include the respective small pistons 88*a*-88*c* having respective small piston outer seals 90*a*-90*c* and small piston inner seals 92*a*-92*c*. The respective large cylinder sleeves 30*a*-30*c* are respectively connected by the respective large cylinder sleeve threads 70*a*-70*c* to the downhole ends of the respective small cylinder sleeves 28*a*-28*c*. The large piston mandrels 74*a*-74*c* are received in the central passages of the respective sleeve connectors 52*a*-52*c*, small piston subs 22*a*-22*c* and small cylinder sleeves 28*a*-28*c* as explained above. The respective large pistons 78*a*-78*c* reciprocate in the respective large piston chambers within the respective large cylinder sleeves 30*a*-30*b*, as also explained above.

The modular force multiplier 10 is assembled working from the downhole end to the work string connection sub 12. The large piston mandrel 74*c* is inserted in the large cylinder sleeve 30*c*, and the small cylinder sleeve 28*c* is slid over the large piston mandrel 74*c* and connected to the large cylinder sleeve thread 70*c*. The small piston sub 22*c* is then slid over the small cylinder sleeve 28*c*, while aligning the small cylinder sleeve anchor slots 62*g*-62*i* (see FIG. 2) with the small cylinder sleeve anchors 60*g*-60*i*. A small cylinder fill bore plug 96*c* (see FIG. 2) is then removed from a small cylinder fill bore 94*c* of the small cylinder sleeve 28*c* and a contained fluid (for example, hydraulic fluid) is pumped into the small cylinder sleeve 28*c* until the space between the small piston 88*c* and the large piston 78*c* is completely filled. Small cylinder fill bore plug 96*c* is then replaced. The sleeve connector anchor ring 64*c* is then slid over exposed ends of the small cylinder sleeve anchors 60*g*-60*i* and the sleeve connector 52*c* is threadedly connected to the small cylinder sleeve anchors 60*g*-60*i*. The small cylinder sleeve lock screws 66*g*-66*i* are then aligned with the respective small cylinder sleeve anchors 60*g*-60*i* and torqued. Large piston 78*b* is then threadedly connected to the large piston mandrel 74*c*. The large cylinder sleeve 30*b* is then slid over the large piston mandrel 74*b* and threadedly secured to the sleeve connector 52*c*. The small cylinder sleeve anchors 60*d*-60*f* are then inserted through small cylinder sleeve anchor slots 60*d*-60*f* of the small cylinder sub 28*b*, contained fluid is pumped through the small cylinder fill bore 94*b* after the small cylinder fill bore plug 96*b* is removed. After the small piston chamber is filled with contained fluid, the debris management sleeve 18*c* is threadedly connected to the small cylinder sub 22*b*. The small cylinder sleeve 28*b* is then threadedly connected to the large piston, sleeve 30*b*, while the large piston sleeve 30*b* is simultaneously threadedly connected to the sleeve connector 52*c*. This process is repeated until bumper mandrel sleeve 42 it is connected to the sleeve connector 52*a*. Then the bumper stop sub 36 is slid over the bumper mandrel 32 and the compression spring 46 is slid over the bumper mandrel 32 behind the bumper stop sub 36. The bumper mandrel 32 is then threadedly connected to the work string connection sub 12 and the debris management sleeve 18*a* is threadedly connected to the work string connection sub thread 16 of the work string connection sub 12. The bumper mandrel stop sub 36 is then threadedly connected to the bumper mandrel sleeve 42 while the downhole end of the debris management sleeve 18*a* is simultaneously connected to the uphole end of the small piston sub 22*a*, which completes the assembly of the modular force multiplier 10.

Figure 4:
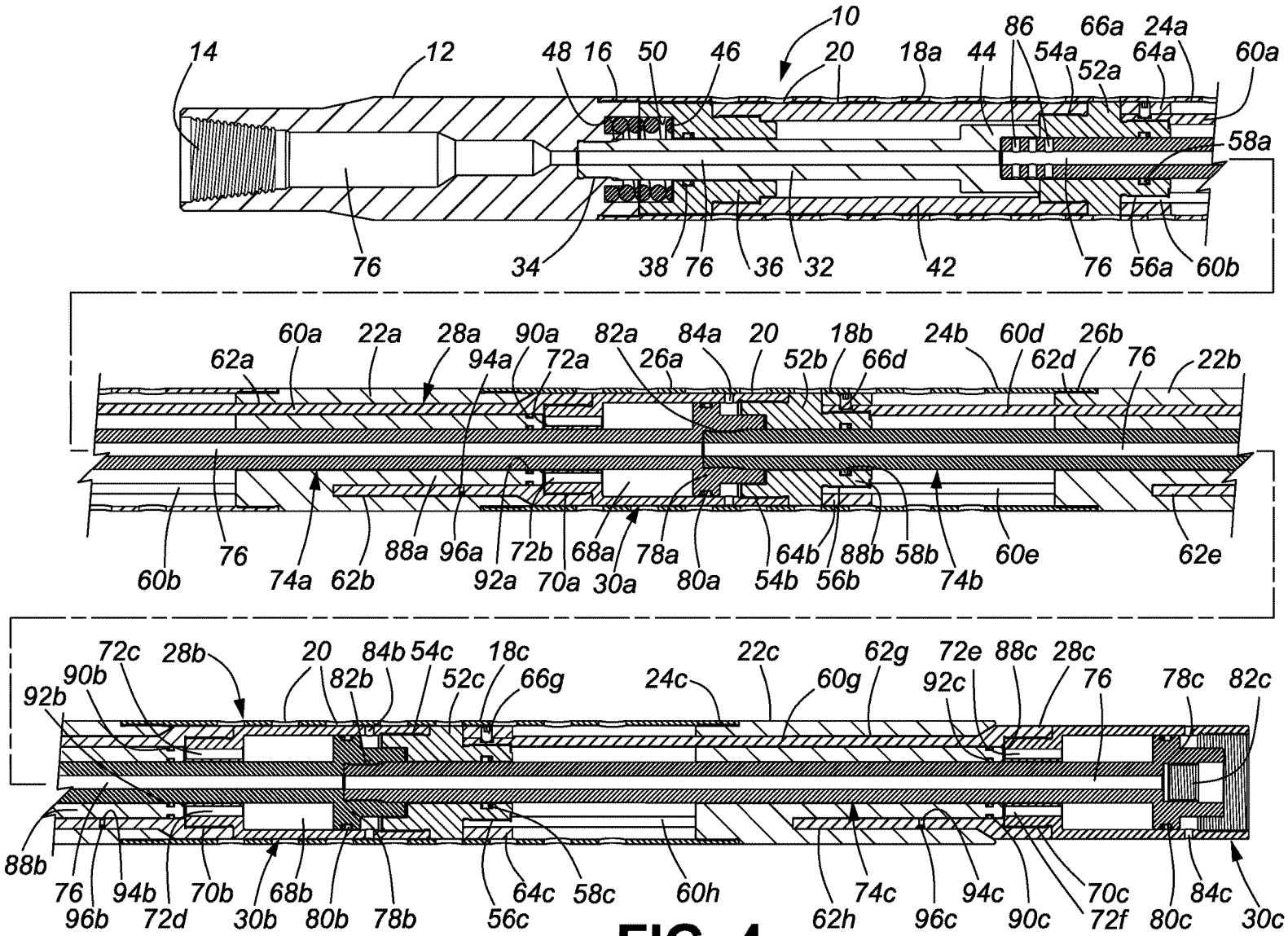
FIG. 4 is a cross-sectional view of the modular force multiplier shown in FIG. 1, subsequent to the multiplication of a push-down force applied to a work string connected to the modular force multiplier.

FIG. 4 is a cross-sectional view of the modular farce multiplier 10 shown in FIG. 1, subsequent to the multiplication of a push-down force applied to the work string 11 connected to the modular force multiplier 10. All the parts and functions of the modular force multiplier 10 have been described above and that description will not be repeated here. After the modular force multiplier 10 has been run into a wellbore to a desired location and, a downhole tool (not shown) connected to the modular force multiplier 10 has been anchored in the wellbore using fluid pressure pumped through a multipart mandrel central passage 76 of the modular force multiplier 10, or a manipulation of a J-latch in the downhole tool, or the like, a push-down force may be applied to the work string 11 to activate the force multiplication function of the modular force multiplier 10. The push-down force compresses the compression spring 46 and urges the interconnected debris management sleeves 18*a*-18*c* and small piston subs 22*a*-22*c* to slide downhole over the inner core of the modular force multiplier 10, which has been described above in detail. The downhole movement of the small piston subs 22*a*-22*c* urges contained fluid within the small cylinder sleeves 28*a*-28*c* to be forced by the small pistons 88*a*-88*c* through the large cylinder sleeve ports 72*a*-72*f*, which drives the respective large pistons 78*a*-78*c* from the run-in condition to the force-multiplied condition, as shown. Because of the relative diameters of the small pistons 88*a*-88*c* and the large pistons 78*a*-78*c*, each module approximately doubles the push-down force. The total force multiplication depends on the number of modular force multiplier modules 100. In this embodiment, the push-downforce is multiplied approximately 6 times.

The explicit embodiments of the invention described above have been presented by way of example only. The scope of the invention is therefore intended to be limited solely by the scope of the appended claims.

We claim:

1. A force multiplier module, comprising a small piston sub connected to a work string, the small piston sub having a small piston that reciprocates, in response to movement of the work string, on a large piston mandrel within a small piston sleeve, and a large piston on an end of the large piston mandrel that reciprocates within a large piston sleeve in response to contained fluid urged by corresponding reciprocation of the small piston.

2. A force multiplier module, comprising:

a small piston sub connected on one end to a debris management sleeve, the small piston sub including a small piston surrounding, a central passage therethrough;

a small cylinder sleeve having small cylinder sleeve anchors that pass through small cylinder sleeve anchor slots in the small piston sub, the small cylinder sleeve surrounding the small piston;

a sleeve connector to which the small cylinder sleeve anchors are connected;

a large cylinder sleeve connected to a downhole end of the small cylinder sleeve, the large cylinder sleeve having at least one fluid port adjacent a central passage therethrough;

a large piston mandrel that extends through the central passage in the large cylinder sleeve, a central passage in the sleeve connector and the central passage in the small piston sub; and a large piston on an end of the large piston mandrel, the large piston being received in the large piston sleeve.

3. The force multiplier module as claimed in claim 2 further comprising a debris management sleeve connecting the small piston sub to a work string connection sub use to connect a work string to the force multiplier module.

4. The force multiplier module as claimed in claim 2 further comprising small cylinder fill bores in the small cylinder sleeve through which contained fluid is introduced into the small cylinder sleeve.

5. The force multiplier module as claimed in claim 3 further comprising:

a bumper mandrel sleeve connected to an uphole end of the sleeve connector;

a bumper mandrel stop sub connected to an uphole end of the bumper mandrel sleeve, the bumper mandrel stop sub having a central passage; and a bumper mandrel having a bumper mandrel socket end, the bumper mandrel being received in a central passage of the bumper mandrel stop sub with the bumper mandrel socket end on a downhole side of the bumper mandrel stop sub and an uphole end of the bumper mandrel being connected to the work string connection sub.

6. The force multiplier module as claimed in claim 4 further comprising a compression spring surrounding the bumper mandrel between the bumper mandrel stop sub and the work string connection sub.

7. A modular force multiplier, comprising:

a work string connection sub; and at least one force multiplier module connected to the work string connection sub, the at least one force multiplier module comprising:

a small piston sub connected on one end to a debris management sleeve, the small piston sub including a small piston surrounding a central passage therethrough;

a small cylinder sleeve having small cylinder sleeve anchors that pass through small cylinder sleeve anchor slots in the small piston sub, the small cylinder sleeve surrounding the small piston;

a sleeve connector to which the small cylinder sleeve anchors are connected;

a large cylinder sleeve connected to a downhole end of the small cylinder sleeve, the large cylinder sleeve having at least one fluid port adjacent a central passage therethrough;

a large piston mandrel that extends through the central passage in the large cylinder sleeve, a central passage in the sleeve connector and the central passage in the small piston sub; and a large piston on an end of the large piston mandrel, the large piston being received in the large piston sleeve;

whereby urging the small piston sub to slide over the large piston mandrel forces contained fluid through ports in the large cylinder sleeve to urge corresponding movement of the large piston.

8. The modular force multiplier as claimed in claim 7 further comprising a bumper mandrel connected to the work string connection sub, the bumper mandrel having a bumper mandrel socket end.

9. The modular force multiplier as claimed in claim 7 further comprising a bumper mandrel stop sub that reciprocates on the bumper mandrel between the work string connection sub and the bumper mandrel socket end.

10. The modular force multiplier as claimed in claim 9 further comprising a bumper mandrel sleeve connected to the bumper mandrel stop sub, the bumper mandrel sleeve defining a bumper mandrel chamber in which the bumper mandrel socket end reciprocates.

11. The modular force multiplier as claimed in claim 7 wherein a downhole end of the bumper mandrel sleeve is connected to an upper sleeve connector thread of the sleeve connector.

12. The modular force multiplier as claimed in claim 7 further comprising a debris management sleeve connected to a downhole end of the work string connection sub and an uphold end of the sleeve connector.

13. The modular force multiplier as claimed in claim 7 wherein the small piston comprises a small piston inner seal that provides a fluid seal between the small piston and the large piston mandrel, and a small piston outer seal that provides a fluid seal between the small piston and the small cylinder sleeve.

14. The modular force multiplier as claimed in claim 13, wherein the small piston further comprises small cylinder fill bores and small cylinder fill plugs.

15. The modular force multiplier as claimed in claim 7, wherein the large piston comprises a large piston seal that provides a fluid seal between the large piston and an inner surface of the large cylinder sleeve.

16. The modular force multiplier as claimed in claim 15 wherein the large piston sleeve further comprises pressure equalization bores.

17. A modular force multiplier, comprising:

a work string connection sub;

a bumper mandrel connected to the work string connection sub, the bumper mandrel having a bumper mandrel socket end;

a bumper mandrel stop sub that reciprocates on the bumper mandrel between the work string connection sub and the bumper mandrel socket end;

a bumper mandrel sleeve connected to a downhole end of the bumper mandrel stop sub, the bumper mandrel sleeve defining a bumper mandrel chamber in which the bumper mandrel socket end reciprocates;

a sleeve connector connected to a lower end of the bumper mandrel sleeve;

a small cylinder sleeve connected on one end to the sleeve connector;

a large cylinder sleeve connected to an opposite end of the small cylinder sleeve;

a large piston adapted to reciprocate in a large piston chamber of the large cylinder sleeve, the large piston having a large piston mandrel that extends through central passages in the large cylinder sleeve and the sleeve connector;

a small piston sub having a small piston surrounding a central passage therethrough, the small piston being adapted to reciprocate on the large piston mandrel within the small cylinder sleeve; and a debris management sleeve connecting the small piston sub to the work string connection sub;

whereby manipulating the work string to urge movement of the small piston sub moves the small piston to force contained fluid in the small piston sleeve through ports in the large cylinder sleeve, to urge corresponding movement of the large piston.

18. The modular force multiplier as claimed in claim 17 further comprising a compression spring between the work string connection sub and the bumper mandrel stop sub, the compression spring continuously urging the modular force multiplier to a run-in condition.

19. The modular force multiplier as claimed in claim 17 further comprising fill ports in the small cylinder sleeve for filling the small cylinder sleeve with contained fluid.

20. The modular force multiplier as claimed in claim 17 further comprising a multipart mandrel central passage through the work string connection sub, the bumper mandrel, and the large piston mandrel to permit fluid to be pumped through the modular force multiplier.

* * * * *